US008356562B2

(12) United States Patent
Palmer

(10) Patent No.: US 8,356,562 B2
(45) Date of Patent: Jan. 22, 2013

(54) PALLET

(75) Inventor: Todd Palmer, Tuscaloosa, AL (US)

(73) Assignee: Pelsco, LLC, Tuscaloosa, AL (US)

( * ) Notice: Subject to any disclaimer, the term of this patent is extended or adjusted under 35 U.S.C. 154(b) by 382 days.

(21) Appl. No.: 12/635,648

(22) Filed: Dec. 10, 2009

(65) Prior Publication Data

US 2010/0147198 A1 Jun. 17, 2010

Related U.S. Application Data

(60) Provisional application No. 61/121,625, filed on Dec. 11, 2008, provisional application No. 61/173,591, filed on Apr. 28, 2009.

(51) Int. Cl.
*B65D 19/38* (2006.01)

(52) U.S. Cl. ..... 108/53.3; 108/57.1; 108/56.1

(58) Field of Classification Search ..... 108/53.3, 108/53.5, 53.1, 57.12, 56.1, 56.3, 57.1, 57.17–57.19
See application file for complete search history.

(56) References Cited

U.S. PATENT DOCUMENTS

| | | | | | |
|---|---|---|---|---|---|
| 3,696,761 | A * | 10/1972 | Brown | ..... | 108/53.3 |
| 4,361,822 | A * | 11/1982 | Adler | ..... | 335/303 |
| 5,195,538 | A * | 3/1993 | Eldridge et al. | ..... | 128/849 |
| 5,745,973 | A * | 5/1998 | Kohlhaas | ..... | 29/432 |
| 2001/0029874 | A1 * | 10/2001 | Muirhead | ..... | 108/57.25 |

* cited by examiner

*Primary Examiner* — Hanh V Tran
(74) *Attorney, Agent, or Firm* — Maschoff Gilmore & Israelsen

(57) ABSTRACT

A pallet may include a first portion and a second portion that may be arranged in a use position. The first and second portions may also be arranged in one or more nested positions that may be more compact than the first position to help facilitate more efficient storage of the portions. The portions may also include one or more magnets that may be used to help secure the portions in the use position and/or the nested positions. The portions may include one or more interlocking and/or engaging features that may be used to help secure the portions in the use position and/or the nested positions. If desired, the first and second portions may be sized and configured to be independently used as pallets.

19 Claims, 5 Drawing Sheets

PALLET

CROSS-REFERENCE TO RELATED APPLICATIONS

This application claims priority to and the benefit of U.S. provisional patent application Ser. No. 61/121,625, filed Dec. 11, 2008, entitled PALLET, and U.S. provisional patent application Ser. No. 61/173,591, filed Apr. 28, 2009, entitled PALLET, which are incorporated by reference in their entireties.

BACKGROUND OF THE INVENTION

1. Field of the Invention

The present invention generally relates to pallets.

2. Description of Related Art

A pallet is a structure that is conventionally used to support goods in a stable fashion while being lifted or moved by devices such as a forklift or pallet jack. The goods are typically placed on top of the pallet and the goods may be secured to the pallet by straps, stretch-wrapped plastic film, etc.

Pallets are frequently used during the transportation process because most pallets can carry a relatively large load and can be used to move heavy stacks of goods. Pallets are also frequently used because goods can be placed on the pallet, and the pallet and goods may be quickly and easily loaded and unloaded from a truck or storage container. In addition, pallets are often used during the storage process because pallets may allow the goods to be readily moved and stored within a store or warehouse.

Pallets often have standard sizes and configurations to facilitate transportation and storage. For example, pallets may have standard sizes to allow the pallets to pass through standard-sized doorways and facilitate loading onto trucks. For example, conventional pallets may have a size of 48 inches by 48 inches, 48 inches by 42 inches, 48 inches by 40 inches, 42 inches by 42 inches, 40 inches by 40 inches, 36 inches by 36 inches, and 45.5 inches by 43 inches.

Known pallets may include a top deck or upper surface upon which the goods may be placed. The upper portion of the top deck typically has a generally flat or planar surface to facilitate placing goods on the pallet. Known pallets may also include a bottom deck or lower surface that is spaced apart form the top deck or surface. The space between the top deck and the bottom deck may facilitate movement of the pallet by a forklift or pallet jack. In particular, the arms of the forklift or pallet jack may be inserted into the space between the top deck and the bottom deck to move the pallet.

One known type of pallet is a stringer pallet that has a frame with three parallel pieces of timber (called stringers). The top deck includes boards that are attached to the stringers to create the pallet. Stringer pallets are known as "two-way" pallets because a forklift or pallet jack may only lift the pallet in two directions instead of four directions.

Another known type of pallet is a block pallet which has both parallel and perpendicular stringers. The parallel and perpendicular stringers may make a stronger pallet and facilitate more efficient handling of the pallet. Block pallets are known as "four-way" pallets because a forklift or pallet jack may be used from any side to move it. That is, a block pallet may allow the arms of the forklift or pallet jack to be inserted in four directions rather than just two directions.

It is known to construct pallets from wood, plastic, aluminum or steel. Wooden pallets may be intended for only a single use and may be discarded as trash along with other shipping or wrapping components after the pallet is used. Wooden pallets may also be intended to be reused. If the wooden pallets are intended to be reused, the pallets are usually constructed from stronger, more durable types of wood and the wooden components are securely connected by nails. Pallets constructed from plastic may provide increased durability, but known plastic pallets cannot be easily repaired and are much more expensive than conventional wooden pallets. In addition, plastic pallets can suffer from plastic creep and these pallets may collapse if used to store or transport heavy loads for long periods of time. Conventional steel pallets are strong and resist to plastic creep. Steel pallets may be used for heavy loads, high-stacking loads, and long term storage. Steel pallets, however, are expensive, weight a significant amount and are susceptible to rusting. The added weight of the steel pallets undesirably increases shipping costs and transportation costs. The added costs of the pallet and increased shipping costs may be very significant, especially because some companies and industries annually purchase, use and ship hundreds, thousands and even hundreds of thousands of pallets. Aluminum pallets may be stronger than wood or plastic, lighter than steel, and resist to weather, rotting, plastic creep and corrosion. Aluminum pallets, however, are expensive and still add significant weight to the goods to be transported, which may undesirably increase shipping and storage costs. Thus, aluminum pallets suffer from some of the same disadvantageous as steel pallets.

After pallets are used to store and/or transport the goods, most pallets are reused. While the pallets are waiting to be reused, however, the pallets must be stored and that may require a significant amount of storage space. In addition, if the unused pallets need to be transported to another location, that may require a significant amount of space. Because conventional pallets may take up a large amount of space, it may be inefficient to store and/or transport the pallets.

BRIEF SUMMARY OF EMBODIMENTS OF THE INVENTION

A need therefore exists for a pallet that eliminates or diminishes the disadvantages and problems described above.

One aspect is a pallet that may include a first portion and a second portion. The first and second portions are preferably sized and configured to be arranged into different configurations. For example, the first and second portions may be arranged into use and/or storage positions. In greater detail, the first and second portions may be arranged in a use position to create a pallet including an upper deck and a lower deck, which may be referred to as a dual-deck pallet. The first and second portions may also be arranged in one or more storage positions, which may facilitate storage of the pallet. In the storage position, the first and second portions may be nested together. Thus, in the storage position, the pallet may take up substantially less space than in the use position. Because the pallet may require significantly less space in the storage position, the pallet may be much more efficiently shipped and stored.

Another aspect is a pallet that may include first and second portions that are interconnected. Desirably, the interconnected portions are movable between use and storage positions. For example, the first and second portions of the pallet may be pivotally connected by a hinge to allow the portions to rotate between use and storage positions. When the pallet is in the use position, the first and second portions may face in generally opposite directions. When the pallet is in the collapsed position, the first and second portions may face the same direction and the portions may be nested together.

Still another aspect is a pallet that may include first and second portions that are interchangeable. This may allow either the first portion or the second portion to form either the upper deck or the lower deck of the pallet. In addition, the first and second portions may have the same size, shape, configuration and/or arrangement. The first and second portions of the pallet may also be identical, which may allow these portions to be readily exchanged. If the first and second portions of the pallet are identical, this may allow the pallet to be used in a wide variety of circumstances and environments. The identical first and second portions may also facilitate repair because one of the portions may be simply replaced. The identical first and second portions may also facilitate stacking of the pallets in the storage position. For example, if the first and second portions are identical, then the portions may be easily aligned. In addition, this may facilitate stacking of the first and second portions for storage.

Yet another aspect is a pallet that may include first and second portions that may be used independently. For example, the first and second portions may include a deck and outwardly extending legs or feet, which may allow the first or second portion to be used by itself as a pallet. For instance, the pallet may only consist of a first portion with an upper deck and downwardly extending legs, and it may not include a lower deck. Therefore, while the first and second portions may be connected to form a pallet with an upper and lower deck, the first and second portions may also be used independently.

A further aspect is a pallet that may include magnets which may be used to secure the first and second portions of the pallet in the use and/or storage positions. For example, the pallet may be primarily constructed from plastic and it may include magnets disposed in one portion and a piece of metal disposed in another portion. When the pallet is in the use position, the magnets may secure the first and second portions together. If desired, the magnets may secure the first and second portions together in the storage position. The magnets may be integrally formed with pallet, if desired. The magnets may also be subsequently attached to the pallet.

A still further aspect is a pallet that may include one or more connecting portions which may help secure the first and second portions of the pallet in the use and/or storage positions. The connecting portions may include interlocking and/or engaging features to allow the first and second portions of the pallet to be securely connected in the use position. The connecting portions may allow the first and second portions of the pallet to be securely connected in the storage position. If desired, the pallets may include both the connecting portions and the magnets, but neither the connecting potions nor magnets are required.

Another further aspect is a pallet that may include one or more feet. For example, the pallet may include first and second portions, and the feet may separate the first and second portions a desired distance when the pallet is in the use position. The feet may be sized and configured to interlock and/or engage each other to help secure the first and second portions in the use and/or storage positions. For example, the first portion may include a first foot with an opening into which a first foot from the second portion may be inserted when the first and second portions are in the use position. In addition, the second portion may include a second foot with an opening into which a second foot of the first portion may be inserted when the first and second portions are in the use position. The feet, however, need not interlock or engage each other and may be adjacent each other when in the use position. When the first and second portions are in a storage position, the feet may be nested together. The feet preferably have the same general shape, size, configuration and arrangement to facilitate nesting. For example, the feet may have a generally square, rectangular and/or oblong shape and may include rounded corners. In addition, the feet may be slightly angled or tapered to facilitate nesting.

Another aspect is a pallet that may include first and second portions that may be quickly and easily arranged into one or more storage or nested positions. For example, the first and second portions may be arranged and/or stacked in a variety of storage or nested positions in which the feet of the first and second portions are nested. The first and second portions may also be arranged and/or stacked into different storage or nested positions in which only a portion of the feet of the first and second portions are nested. Desirably, because the first and second portions of the pallet may be arranged in various storage or nested positions, a plurality of pallets may be quickly and easily stored. This may allow, for example, the portions of the pallet to completely overlap and be stacked one on top of the other in the use or storage positions. Alternatively, this may allow only a portion of the pallets to be overlapped in the use or storage positions.

Yet another aspect is a pallet that may be primarily constructed from plastic. For example, the pallet may include a first portion that is primarily constructed from plastic and a second portion that is primarily constructed from plastic. The various portions of the pallet may be integrally formed as part of a unitary, one piece structure during the molding process. Advantageously, one or more components may be molded into the plastic during the molding process. For example, magnets or other structures may be placed in the mold during the molding process and the plastic may at least partially enclose or encapsulate the magnets or other structures.

A further aspect is a pallet that may include magnets disposed within holsters or insulators. The holsters or insulators may be molded and/or embedded into the plastic, and the holsters or insulators may be constructed from ceramic and/or other materials with suitable characteristics. Advantageously, the holsters or insulators may help the magnets retain their magnetism during the manufacturing process. For example, the high temperature molding of the plastic into the desired shape and configuration may cause the magnets to significantly decrease or completely lose their magnetism. The holsters or insulators may protect the magnets during the manufacturing process so that the magnets do not lose their magnetism.

A still further aspect is a pallet that may include upper and lower decks with a plurality of ribs or cross members. The ribs or cross members may help strengthen the pallet while reducing the weight of the pallet. Advantageously, if the weight of the pallet is reduced, then shipping and transportation costs may be reduced. In addition, if the ribs and cross members allow the pallet to be constructed from less material, then manufacturing costs may be reduced. The ribs and cross members may allow the decks to have a waffle-shaped configuration and the ribs may be arranged in a grid. The first and second portions may also include one or more reinforcing members, such as metal rods or tubes. The reinforcing members may be disposed inside the first and second portions of the pallet, partially disposed within the pallet, or exposed.

Another further aspect is a pallet that may include a locking mechanism to secure the pallet in the use and/or storage positions. The locking mechanism may include one or more latches that may secure the first and second portions of the pallet together. For example, the first portion of the pallet may a latch that is sized and configured to engage the second portion, and the second portion of the pallet may include a latch that is sized and configured to engage the first portion.

Another aspect is a pallet that may include a locking mechanism which is sized and configured to automatically secure the first and second portions together. For example, the locking mechanism may include latches that automatically lock the first and second portions together. The latches may move from a disengaged or unlocked position to an engaged or locked position when the first and second portions are connected to form a pallet.

Still another aspect is pallet that may include a first portion with a deck and a second portion with a deck to form a dual-deck pallet. The first and second portions of the pallet may also include outwardly extending feet, which may space the decks of the pallet a desired distance apart and help interconnect the portions. For example, the first portion of the pallet may include a first foot with a first opening and a first foot of the second portion of the pallet may be at least partially disposed within the first opening. The second portion may include a second foot with a second opening and a second foot of the first portion may be at least partially disposed within the second opening. The first portion may also include a magnet and it may be connected to a first metal member of the second portion when the pallet is in the use position. In addition, the second portion may include a magnet and it may be connected to a second metal member of the first portion when the pallet is in the use position. The magnets may help retain the first and second portions of the pallet in the desired configuration and arrangement.

Yet another aspect is pallet that may include magnets and metal members disposed in a plurality of locations. For example, the pallet may include first and second portions with outwardly extending feet, and magnets and metal members may be disposed at least proximate the feet. In particular, magnets and metal members may be disposed at least proximate the bases and ends of the feet. if desired, the feet, magnets and metal members may be disposed proximate one or more corners and central portions of the pallet.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards pallets that are movable between use and storage positions. The principles of the present invention, however, are not limited to pallets that are movable between use and storage positions. It will be understood that, in light of the present disclosure, the pallets disclosed herein can have a variety of suitable shapes, sizes, configurations and arrangements depending, for example, upon the intended use of the pallets.

Additionally, to assist in the description of the pallets, words such as top, bottom, front, rear, right and left may be used to describe the accompanying figures, which may be but are not necessarily drawn to scale. It will also be appreciated that the pallets can be located in a variety of desired positions and/or orientations. A detailed description of the pallets now follows.

Figure 1:
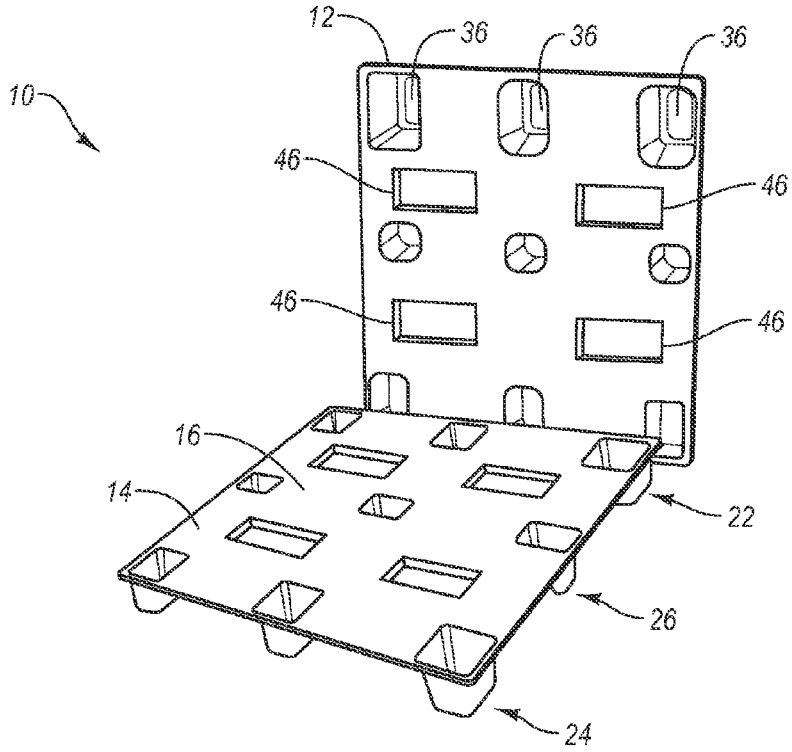
FIG. 1 is a perspective view of an exemplary pallet, illustrating a first portion and a second portion of the pallet.

As shown in FIG. 1, a pallet 10 may include a first portion 12 and a second portion 14. As discussed below, the first and second portions 12, 14 may be arranged in a first or use position to create a pallet (for instance, a dual-deck pallet including upper and lower decks or any other suitable type of pallet). The first and second portions 12, 14 may also be arranged into a second or storage position.

The pallet 10 is preferably a standard sized pallet. For example, the pallet 10 may have a size of 48 inches by 48 inches, 48 inches by 42 inches, 48 inches by 40 inches, 42 inches by 42 inches, 40 inches by 40 inches, 36 inches by 36 inches, and 45.5 inches by 43 inches. The pallet 10, however, may have a variety of sizes. The pallet 10 may also be sized and configured to carry any desired goods or products. Thus, it will be appreciated that the pallet 10 may have any desired shape, size, configuration and arrangement depending, for example, upon the intended use of the pallet.

The first and second portions 12, 14 of the pallet 10 may also be arranged in a nested or second position that may be more compact than the first position to help facilitate more efficient storage of the pallet. This may advantageously allow the pallets 10 to carry items from one location to another location in the first position. At the destination, the first and second portions 12, 14 of the pallet 10 may be arranged in the nested or second position for storage. When a sufficient number of pallets 10 have been received at the destination, the pallets may be shipped in the second position back for reuse. Desirably, when in the second position, the portions 12, 14 of the pallet 10 are significantly more compact than in the first position. This may facilitate more efficient storage of the pallets 10 at any location, such as when the pallets are manufactured, sent to the original shipper, stored at the destination, or sent to another shipper.

In further detail, the pallet 10 may include a base or deck 16 with a first end 18 and a second end 20. The pallet 10 may also include one or more supports or feet that extend away from the base. In particular, the pallet 10 may include first and second sets of feet 22, 24 disposed at least proximate the first and second ends of the deck 16, respectively. The pallet 10 may also include a third set of feet 26 disposed between the first and second sets of feet 22, 24. If desired, the sets of feet 22, 24, 26 may be arranged in rows, some or all of which may be parallel or at least substantially parallel to each other. The feet 22, 24, 26, however, need not be arranged in rows and may be disposed in other suitable arrangements and/or locations. In some embodiments, the first and second portions 12, 14 of the pallet 10 may have generally the same configuration. In particular, the first and second portions 12, 14 of the pallet 10 may have decks 16, feet 22, feet 24 and/or feet 26 that are the same or have a similar shape, size, configuration and arrangement. Advantageously, this may allow the first and second portions 12, 14 of the pallet 10 to be interchangeable, but this is not required.

Figure 3:
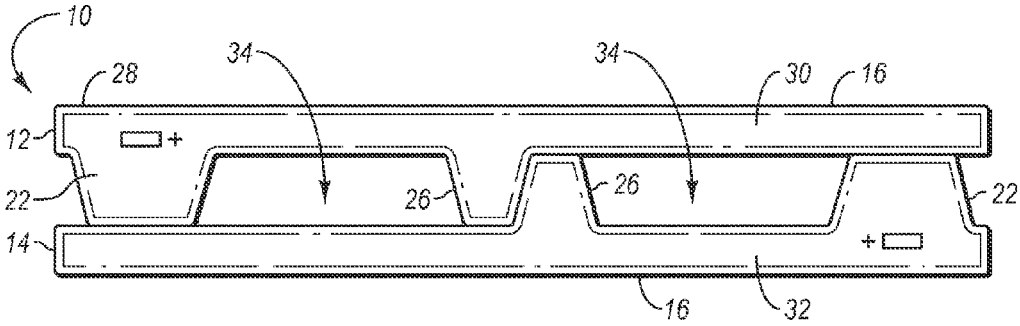
FIG. 3 is a side view of the pallet shown in FIG. 1, illustrating the first and second portions of the pallet in an exemplary position.
Figure 4:
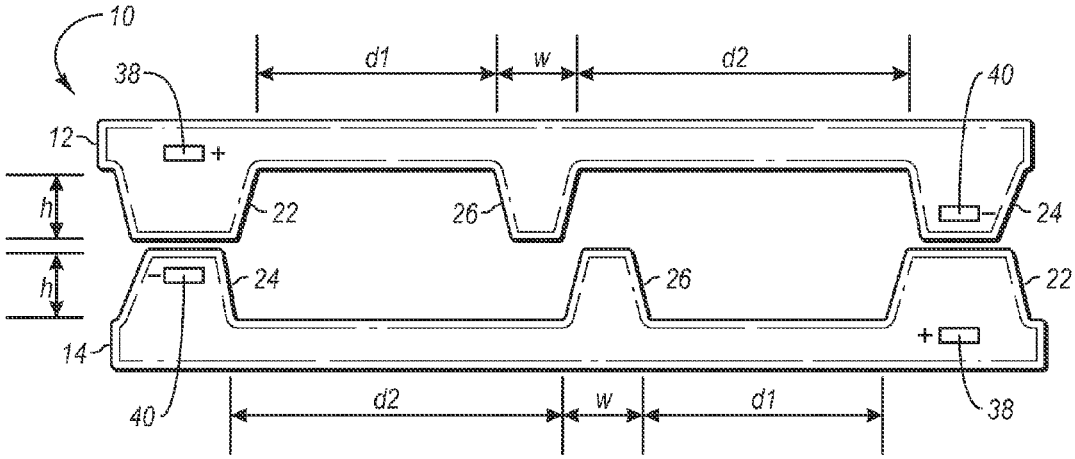
FIG. 4 is side view of the pallet shown in FIG. 1, illustrating the first and second portions of the pallet in another exemplary position.

As shown in FIGS. 3-4, the pallet 10 may have a dual-deck configuration 28 including an upper deck 30 and a lower deck 32. The dual-deck pallet 10 may be formed by the first portion 12 forming the upper deck 30 and the second portion 14 forming the lower deck 32. In this configuration, the first and second portions 12, 14 may face in generally opposite directions. As shown in FIG. 3, when the portions 12, 14 are arranged in this first position, the feet 22, 24, 26 of the first portion 12 may extend downward and may contact, abut and/or engage the deck 16 of the second portion 14. In addition, the feet 22, 24, 26 of the second portion 14 may extend upward and may contact, abut and/or engage the deck 16 of the first portion 12. Desirably, this may help strengthen and/or reinforce the pallet 10. It will be appreciated that, although the first and second portions 12, 14 are illustrated and described as forming upper and lower decks respectively, the first and second portions may be positioned such that the first portion forms the lower deck and the second portion forms the upper deck, if desired.

When the portions 12, 14 are arranged in the first position shown in FIG. 3, the feet 22, 24, 26 may space the upper and lower portions apart a desired distance. In addition, the feet 22, 24, 26 and the upper and lower decks 30, 32 may help define a plurality of fork-receiving portions 34 that are sized and configured to receive the forks of a lifting mechanism, such as forklifts, pallet jacks (also known as pallet trucks or pump trucks), and the like. This may allow the pallet 10 to be lifted and/or carried by such lifting mechanisms.

The first and second portions 12, 14 of the pallet 10 may include one or more engaging and/or interlocking features that may be used to help secure the portions in the first position. In particular, the first portion 12 may include at least one foot that is sized and configured to engage and/or interlock with a foot of a second portion 14 when the pallet is in the first position. For example, the first portion 12 may include at least one foot that includes an opening that is sized and configured to receive, engage and/or interlock with at least a portion of a foot of the second portion 14 when the pallet 10 is in the first position. The second portion 14 may include at least one foot that includes an opening sized and configured to receive, engage and/or interlock with at least a portion of a foot of the first portion 12 when the pallet 10 in the first position.

Figure 2:
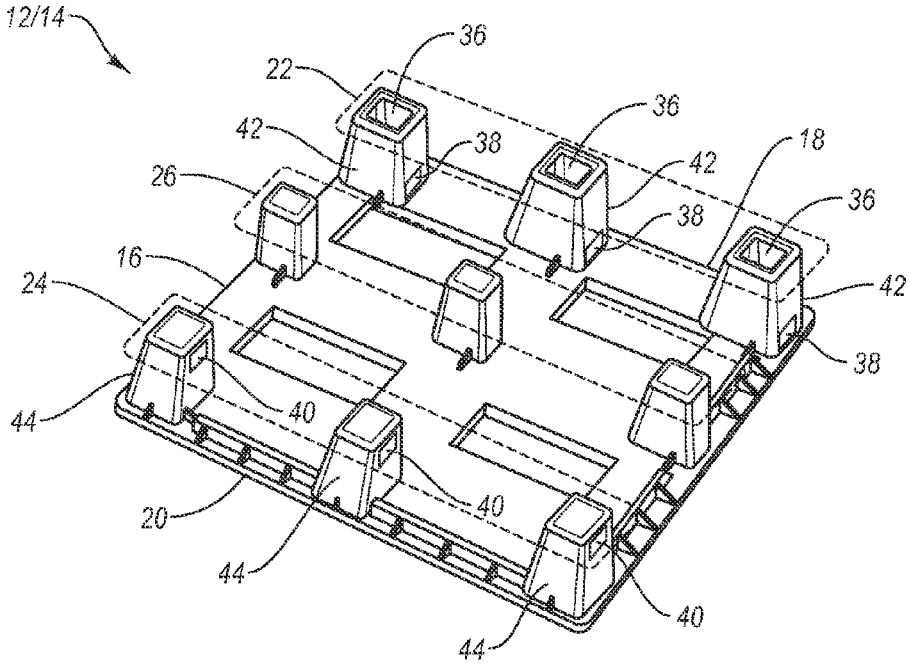
FIG. 2 is a perspective view of a portion of the pallet portion shown in FIG. 1.

In further detail, as shown in FIGS. 1-2, the feet 22 of the first and second portions 12, 14 of the pallet 10 may include openings 36 and a hollow interior. As shown in FIGS. 3-4, at least one foot 24 of the first portion 12 may be at least partially inserted into the opening 36 and hollow interior of a foot 22 of the second portion 14. In addition, at least one foot 24 of the second portion 14 may be at least partially inserted into the opening 36 and hollow interior of a foot 22 of the first portion 12. This may allow the feet 22, 24 to engage and/or interlock with each other, which may advantageously help secure the first and second portions 12, 14 of the pallet in the first position. The feet 22, 24 may also be sized and configured to engage and/or interlock with each other using a snap, friction and/or interference fit when the pallet 10 is in the first position.

Figure 6:
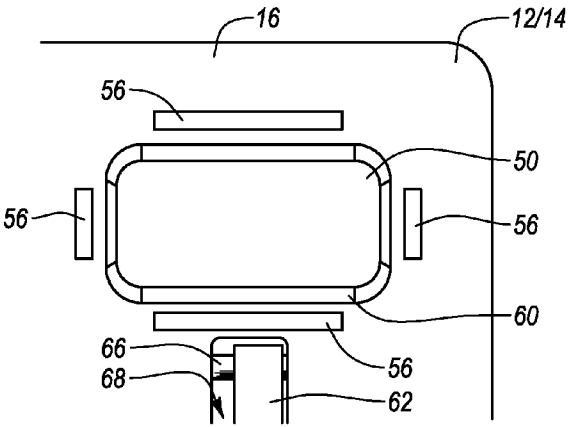
FIG. 6 is a top view of an exemplary portion of a pallet, illustrating a foot.
Figure 7:
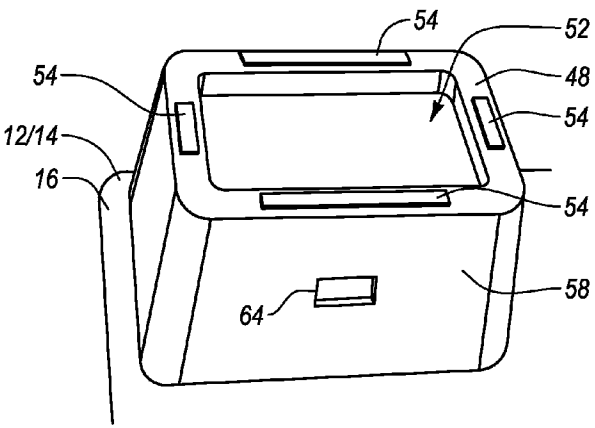
FIG. 7 is a perspective view of another exemplary portion of the pallet, illustrating another foot.

The feet 22, 24 and the openings 36 may have a variety of shapes, sizes, configurations and arrangements that may facilitate engaging and/or interlocking of the first and second portions 12, 14 of the pallet 10. In further detail, the feet 22 may include a base proximate the deck 16 and an end that extends away from the base and deck. The bases of the feet 24 may have a generally square shape that may be about 3.5 inches by 3.5 inches, and the openings 36 may have a generally square shape that may be about 4 inches by 4 inches, which may facilitate insertion of the feet into the openings. In addition, the feet 24 may also have a generally tapered shape with ends that may have a generally square shape and may be about 2.5 inches by 2.5 inches, which may further facilitate insertion of the feet into the openings 36. The feet 24 may also include a base proximate the deck 16 and an end that extends away from the base and deck. The base of the feet 22 may have a generally square shape that may be about 6 inches by 6 inches. In addition, the feet 22 may have a generally tapered shape with ends that may have a generally square shape and may be about 4 inches by 4 inches. In addition, the feet 22, 24 and the openings 36 may have generally rounded corners. It will be appreciated that the feet 22, 24 and the openings 36 may have generally rectangular, oblong and/or other suitable sizes, shapes and/or configurations depending, for example, upon the intended use of the pallet 10. For instance, as shown in FIGS. 6-7, the feet 22, 24 and the openings 36 may have generally rectangular and/or oblong shape. It will also be appreciated the openings 36 are not required and the first and second portions 12, 14 and/or the feet 22, 24 may engage and/or interlock using other suitable components and/or features.

As best seen in FIG. 4, to facilitate placement of the first and second portions 12, 14 of the pallet 10 in the first position, the feet 26 may be offset from the center of the deck 16 towards the feet 22 and/or away from the feet 24. For example, the feet 26 may be disposed at a first distance d1 from the feet 22 and a second distance d2 from the feet 24, and d2 may be about at least about 20%, 30%, 40% and/or 50% larger than d1. In one instance, first distance d1 may be between about 10.5 inches and the second distance d2 may be about 16.5 inches, however, the first and second distances may be larger or smaller, if desired. Also, the feet 26 may have a width w and the feet 26 may be offset from the center of the deck towards the feet 22 at a distance that is at least about 20%, 30%, 40% and/or 50% the width w. Significantly, as shown in FIG. 3, the offset placement of the feet 26 may allow the feet 26 of the portions 12, 14 to be adjacent when in the first position. If desired, the feet 26 may be offset towards the feet 24. Also, some of the feet 26 may be offset towards the feet 22, while some of the feet 26 may be offset towards the feet 24. It will be appreciated, however, that the feet 26 need not be offset.

The portions 12, 14 of the pallet 10 may also include magnets configured to help secure the portions in the first position shown in FIG. 3. In particular, as shown in FIG. 2, magnets 38, 40 may be disposed on the feet 22, 24 and the magnets of the portions 12, 14 may be generally aligned when the portions are in the first position. This may advantageously help secure the portions 12, 14 in the first position.

In further detail, as shown in FIG. 2, the feet 22, 24 may include a body 42, 44 that includes a base proximate the deck 16 and an end that extends away from the base and deck. To help align the magnets when the portions 12, 14 of the pallet 10 are in the first position, one or more magnets 38 may be disposed at least proximate the base of the body 42 of a foot 22, and one or more magnets 40 may be disposed at least proximate the end of the body 44 of a foot 24. In some configurations, to help align the magnets when the portions 12, 14 are in the first position, one or more of the magnets 38 may be disposed at least proximate the end of the body 42, and one or more of the magnets 40 may be disposed at least proximate the base of the body 44. The magnets 38, 40 could also be disposed at the ends, bases and/or other portions of the bodies 42, 44 of the feet 22, 24 depending, for example, upon the particular configuration of the feet. It will be appreciated that the magnets 38, 40 need not be disposed on the feet 22, 24 and may be disposed at other suitable locations on the portions 12, 14 to help secure the portions in the first position.

The magnets 38, 40 may have complementary positive and negative portions that may be disposed at least proximate and/or extend towards each other when the portions 12, 14 of the pallet 10 are in the first position shown in FIG. 3. For instance, in some configurations, the magnets 38 may include a positive portion disposed towards the interior of the feet 22, and the magnets 40 may include a negative portion disposed towards the exterior of the feet 24. Consequently, when the feet 24 are inserted into the feet 22, the positive and negative portions of the generally aligned magnets 38, 40 may be disposed towards each other, which may secure the first and second portions 12, 14 in the first position. By pulling and/or keeping themselves together, the positive and negative portions of the magnets 38, 40 may help retain at least a portion of the feet 24 within the openings 36 of the feet 22. To provide the same or similar effect, the magnets 38 could include a negative portion disposed towards the interior of the feet 22, and the magnets 40 could include a positive portion disposed towards the exterior of the feet 24.

Figure 5:
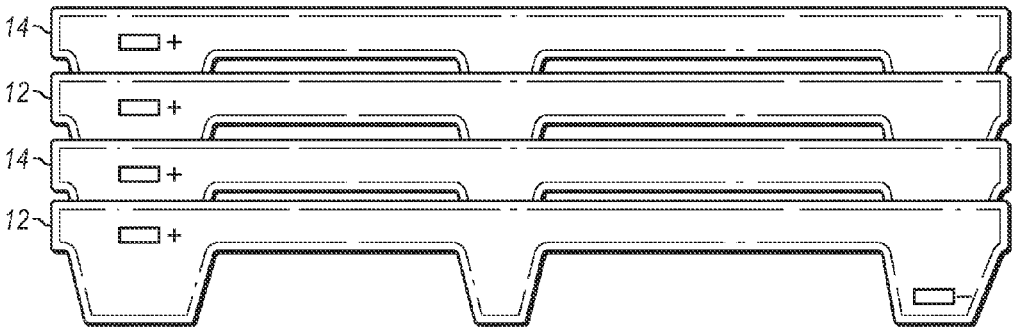
FIG. 5 is a side view of a plurality of pallets in a nested position.

As shown in FIG. 5, to facilitate more efficient storage, the first and second portions 12, 14 of the pallet 10 may be arranged in a second position in which the portions face generally the same direction and/or nest together. If desired, three or more of the portions 12, 14 may face generally the same direction and/or nest together. This nested arrangement may significantly decrease the amount of storage spaced need to store and/or transport the portions 12, 14.

The first and second portions 12, 14 may include one or more engaging and/or interlocking features that may be used to help secure the portions in the second position. For example, the first portion 12 may include a foot that is sized and configured to engage and/or interlock with a foot of the second portion 14 when the first and second portions are in the second position. Similarly, the second portion 14 may include a foot that is sized and configured to engage and/or interlock with a foot of the first portion 12 when the first and second portions are in the second position.

In further detail, the feet 22, 24, 26 of the first and second portions 12, 14 may include hollow interiors shown in FIG. 1, which may allow the feet to nest together in the more compact second position shown in FIG. 5. For example, the feet 22, 24, 26 of the first portion 12 may be at least partially inserted into the hollow interiors of the feet 22, 24, 26 of the second portion 14, respectively, or the feet 22, 24, 26 of the second portion 14 may be at least partially inserted into the hollow interiors of the feet 22, 24, 26 of the first portion 12, respectively. This may allow the feet 22, 24, 26 to engage and/or interlock with each other, which may advantageously help secure the first and second portions 12, 14 in the second position. The feet 22, 24, 26 may be further sized and configured to engage and/or interlock with each other using a snap, friction and/or interference fit when the portions 12, 14 are in the second position.

If desired, when the first and second portions 12, 14 are in the second position shown in FIG. 5, the magnets 38 of the first and second portions may be disposed at least proximate to each other, and the magnets 40 of the first and second portions may be disposed at least proximate to each other. In some configurations, the magnets 38 may include a positive portion disposed towards the interior of the feet 22 and a negative portion disposed towards the exterior of the feet 22, and the magnets 40 may include a negative portion disposed towards the interior of the feet 24 and a positive portion disposed towards the exterior of the feet 24. Consequently, when the feet 22, 24 of one portion are inserted into the hollow interior of the feet of the other portion, the positive and negative portions of the magnets 38 may be disposed towards each other to pull and/or keep themselves together, and the positive and negative portions of the magnets 40 may be disposed towards each other to pull and/or keep themselves together, which may help secure the portions in the second position. By pulling and/or keeping themselves together, the magnets 38 and/or the magnets 40 may help retain at least a portion of the feet 22, 24 of one portion are within the hollow interior of the feet of the other portion. To provide the same or similar effect, the magnets 38 could include a negative portion disposed towards the interior of the feet 22 and a positive portion disposed towards the exterior of the feet 22, and the magnets 40 could include a positive portion disposed towards the interior of the feet 24 and a negative portion disposed towards the exterior of the feet 24.

Thus, the magnets 38, 40 may be configured to help secure the first and second portions 12, 14 in the first position shown in FIG. 1. The magnets 38, 40 may also be configured to secure the first and second portions 12, 14 in the second position shown in FIG. 5. Moreover, if the portions 12, 14 are unintentionally dislodged from the first or second position, the magnets 38, 40 may help pull the portions 12, 14 from the dislodged position back to the desired position. One or more of the magnets 38, 40 could be replaced other structures such as metal members, plates, beams, tubes and the like. The magnets 38, 40 may be attracted to these other structures. It will be appreciated that the magnets 38, 40 and other structures may be disposed in various suitable locations, and constructed from various materials, depending, for example, upon the intended use of the pallet 10.

As discussed above, the first and second portions 12, 14 of the pallet 10 may be arranged in a position in which the portions face generally the same direction and/or nest together. As shown in FIG. 5, the nested portions may share the same orientation such that the feet 22, 24, 26 of one portion are respectively aligned with (and nest within) the feet of another portion. In some embodiments, however, the same orientation is not required for nesting. Thus, the portions 12, 14 of the pallet 10 may nest together regardless of the orientation of the portions.

As shown in FIG. 1, a portion 12, 14 of the pallet 10 may include one or more knockouts 46 for a lifting mechanism, such as a pallet jack. The knockouts 46 may, for example, be formed in the deck 16 of the portion 12, 14 and may be sized and configured to receive at least a portion of a wheel of the pallet jack. It will be appreciated, however, that the knockouts 46 are not required.

As shown in FIGS. 6-9, the first and second portions 12, 14 of the pallet 10 may include feet 48, 50 in place of, or in addition to, the feet 22, 24. The feet 48, 50 may include any of the positions, features and/or functionality of the feet 22, 24. For example, the feet 48 may include openings 52 and a hollow interior, and a foot 50 of one portion 12, 14 may be at least partially inserted into the opening 52 and hollow interior of a foot 48 of another portion 12, 14. In addition, a foot 50 of one portion 12, 14 may be at least partially inserted into the opening 52 and hollow interior of a foot 48 of another portion 12, 14. This may allow the feet to engage and/or interlock with each other, which may advantageously help secure the portions 12, 14 of the pallet 10 in the first position. Also, for example, the feet 48 may nest together and the feet 50 may nest together, which may advantageously help secure the portions 12, 14 of the pallet 10 in the second position. It will be appreciated, however, that the feet 48, 50 do not require the positions, features and functionality of the feet 22, 24 and may include other positions, features and functionality, if desired.

The portions 12, 14 of the pallet 10 may also include magnets 54, 56 in place of, or in addition to, the magnets 38, 40. The magnets 54, 56 may include any of the positions, features and/or functionality of the magnets 38, 40. For example, positive and negative portions of the magnets 54, 56 may be generally aligned to help secure the first and second portions 12, 14 of the pallet 10 in the first position and/or the second position. It will be appreciated, however, that the magnets 54, 56 do not require the positions, features and functionality of the magnets 38, 40 and may include other positions, features and functionality, if desired.

To help align the magnets when the portions 12, 14 of the pallet 10 are in the first position, one or more magnets 54 may be disposed at least proximate the end of a body 58 of the feet 48, and one or more magnets 56 may be disposed at least proximate the base of a body 60 of the feet 50. In particular, the magnets 54 may be connected to the end of the body 58 of the feet 48, and the magnets 56 may be connected to the deck 16 and may abut the base of the body 60 of the feet 50.

As shown in FIGS. 6 and 7, the magnets 54, 56 may have elongated configurations. The perimeter of the end of the body 58 may have a number of sides and one or more elongated magnets 54 may be disposed at least proximate some or all of the sides. In addition, the perimeter of the base of the body 56 may have a number of sides and one or more elongated magnets 56 may be disposed at least proximate some or all of the sides.

If desired, the elongated magnets 54 or the elongated magnets 56 could be replaced by other elongated structures such as elongated metal members, plates, beams, tubes and the like. The magnets 54, 56 may be attracted to these other structures. It will be appreciated that the magnets 54, 56 and other structures may be disposed in various suitable locations, and constructed from various materials, depending, for example, upon the intended use of the pallet 10. It will also be appreciated that the magnets 54, 56 and other structures do not require elongated configurations and may have any of a variety of other suitable sizes, shapes and/or configurations.

Figure 8:
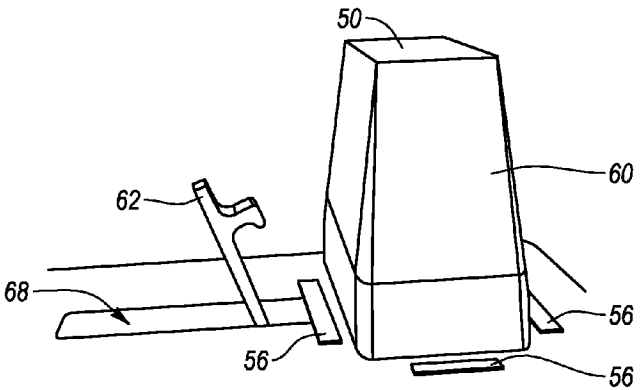
FIG. 8 is a perspective view of the portion of the pallet shown in FIG. 6, illustrating the foot and a latch.
Figure 9:
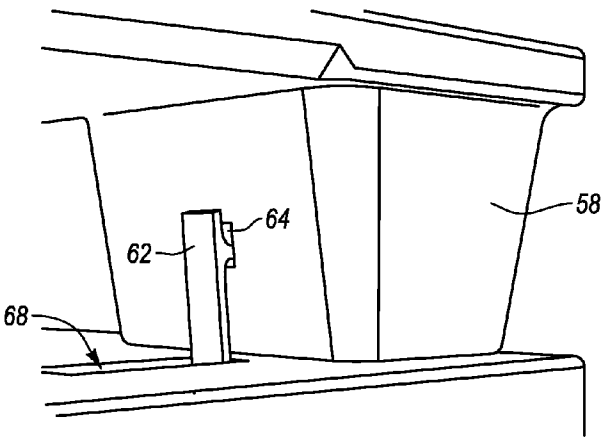
FIG. 9 is a perspective view of the foot and latch shown in FIGS. 6 and 8 connected to the foot shown in FIG. 7.

As shown in FIGS. 8-9, a locking mechanism may be sized and configured to secure the first and second portions 12, 14 of the pallet 10 together. The locking mechanism may include, for example, one or more latches. In particular, the first portion 12 of the pallet 10 may include one or more latches 62 that may be sized and configured to engage the second portion 14, and the second portion of the pallet may include one or more latches 62 that may be sized and configured to engage the first portion. For instance, the latches 62 of the first portion 12 may engage openings 64 in feet 48 of the second portion, and the latches 62 of the second portion may engage openings 64 in feet 48 of the first portion. It will be appreciated, however, that the latches 62 may engage other suitable portions of the pallet and the locking mechanism does not require any latches and may include other suitable structures and/or components.

The locking mechanism may be sized and configured to automatically secure the first and second portions 12, 14 together. For example, the latches 62 that may automatically pivot and/or move from a disengaged or unlocked position to an engaged or locked position when the first and second portions 12, 14 are connected to form a pallet. The latches 62 may be movably and/or pivotally connected to the deck 16 using a pin 66 shown in FIG. 6 or other suitable means.

As shown in FIGS. 6 and 8, the deck 16 may include receiving portions 68 that may be sized and configured to receive and/or retain at least a portion of the latches 62. The receiving portions 68 may, for instance, allow the latches 62 to lie at least substantially flat against the deck 16 when in the disengaged or unlocked position.

Figure 10:
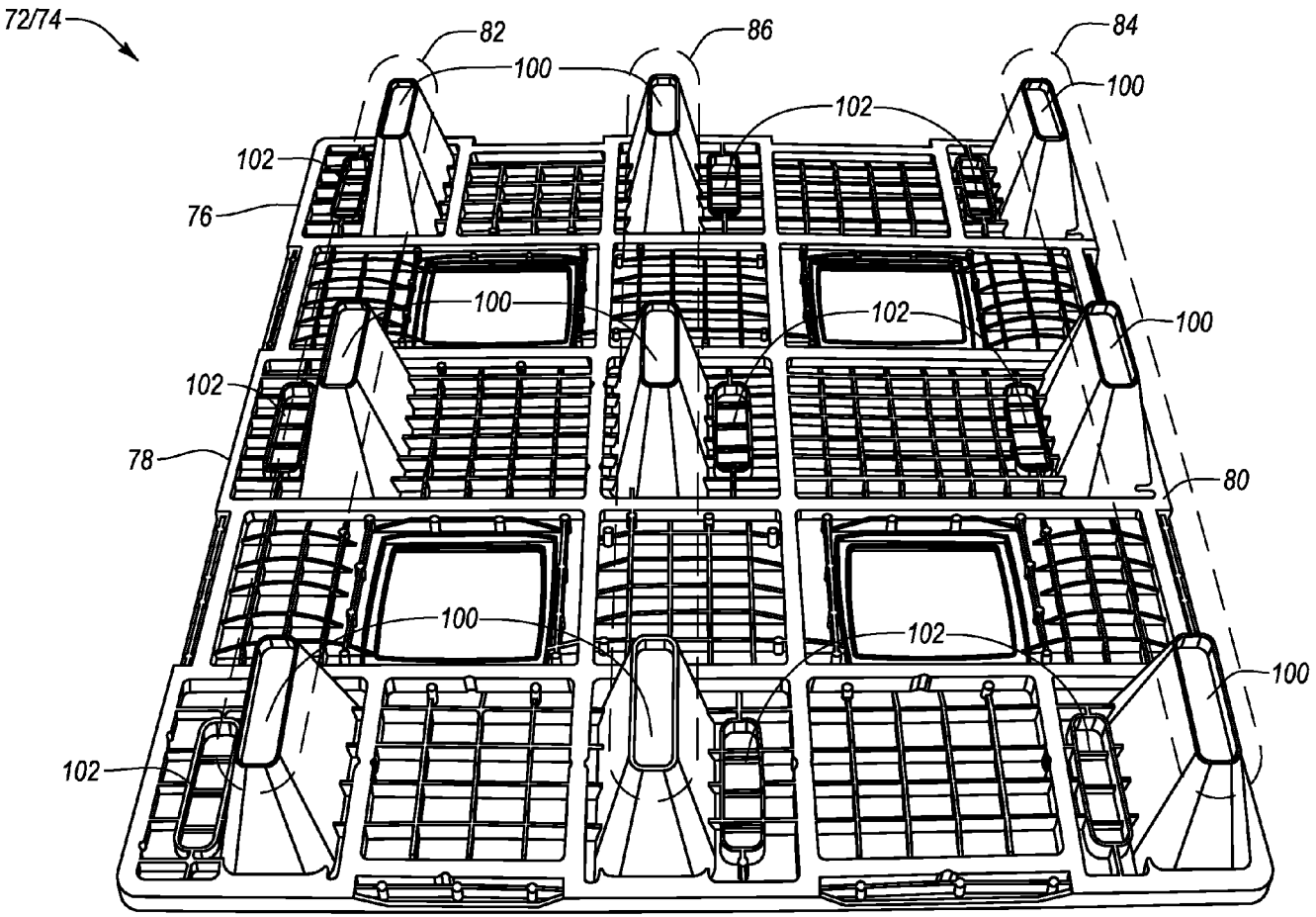
FIG. 10 is a perspective view of a portion of another exemplary pallet.
Figure 11:
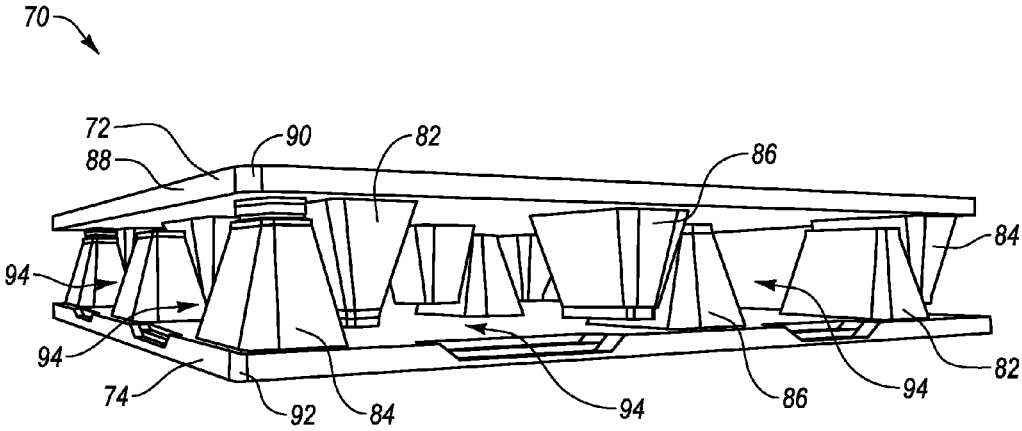
FIG. 11 is a perspective view of two portions of the pallet shown in FIG. 10.
Figure 12:
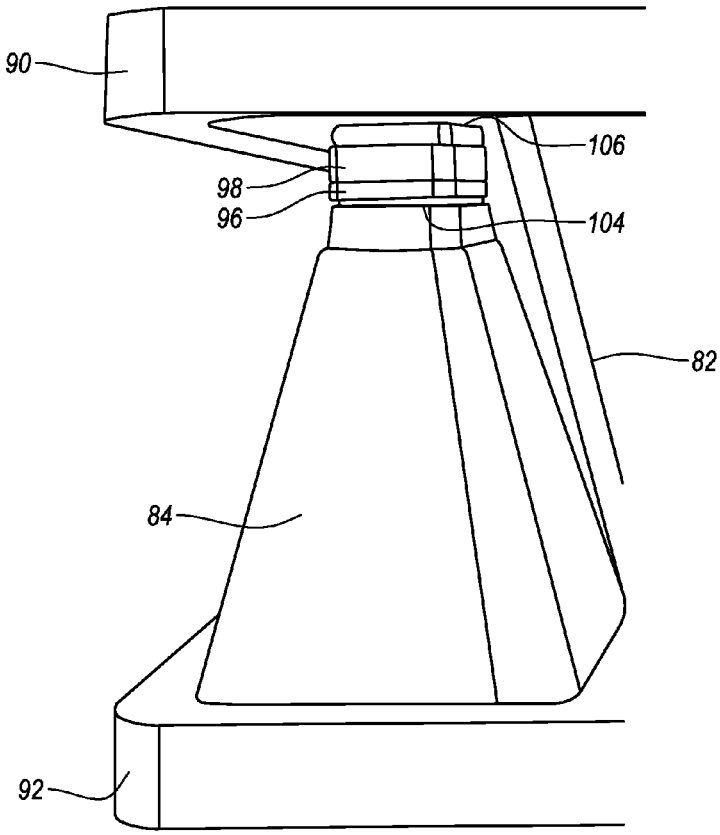
FIG. 12 is a perspective view of a portion of the pallet shown in FIG. 11.

As shown in FIGS. 10-12, a pallet 70 may include one or more portions 72, 74. The portions 72, 74 of the pallet 70 may include any of the features and functionality of the portions 12, 14 and/or other features and functionality. For example, the portions 72, 74 of the pallet 70 may be arranged in a first position to create a pallet (for instance, a dual-deck pallet including upper and lower decks or any other suitable type of pallet), and the portions 72, 74 may also be arranged in a nested, second position that may be more compact than the first position to help facilitate more efficient storage of the portions. This nested, second position may be similar to the arrangement of portions 12, 14 of the pallet shown in FIG. 5.

In further detail, the pallet 70 may include a base or deck 76 with a first end 78 and a second end 80. The pallet 70 may also include one or more supports or feet that extend away from the base. In particular, the pallet 70 may include first and second sets of feet 82, 84 disposed at least proximate the first and second ends of the deck 76, respectively. The pallet 70 may also include a third set of feet 86 disposed between the first and second sets of feet 82, 84. If desired, the sets 82, 84, 86 of feet may be arranged in rows, some or all of which may be parallel or at least substantially parallel to each other. The feet 82, 84, 86, however, need not be arranged in rows and may be disposed in other suitable arrangements and/or locations. In some embodiments, the first and second portions 72, 74 of the pallet 70 may have generally the same configuration. In particular, as shown in FIG. 10, the first and second portions 72, 74 may have decks 76, feet 82, feet 84 and/or feet 86 that are the same or have a similar shape, size, configuration and arrangement. Advantageously, this may allow the first and second portions 72, 74 of the pallet 70 to be interchangeable, but this is not required.

As shown in FIG. 11, the pallet 70 may have a dual-deck configuration 88 including an upper deck 90 and a lower deck 92. The dual-deck pallet 70 may be formed by the first portion 72 forming the upper deck 90 and the second portion 74 forming the lower deck 92. In this configuration, the first and second portions 72, 74 may face in generally opposite directions. When the portions 72, 74 are arranged in this first position, the feet 82, 84, 86 of the first portion 72 may extend downward and may contact, abut and/or engage the deck 76 of the second portion 74. In addition, the feet 82, 84, 86 of the second portion 74 may extend upward and may contact, abut and/or engage the deck 76 of the first portion 72. Desirably, this may help strengthen and/or reinforce the pallet 70. It will be appreciated that, although the first and second portions 72, 74 are illustrated and described as forming upper and lower decks respectively, the first and second portions may be positioned such that the first portion forms the lower deck and the second portion forms the upper deck, if desired.

In addition, when the first and second portions 72, 74 are arranged in the first position shown in FIG. 10, the feet 82, 84, 86 may space the upper and lower portions apart a desired distance. In addition, the feet 82, 84, 86 and the upper and lower decks 90, 92 may help define a plurality of fork-receiving portions 94 that are sized and configured to receive the forks of a lifting mechanism, such as forklifts, pallet jacks (also known as pallet trucks or pump trucks), and the like. This may allow the pallet 70 to be lifted and/or carried by such lifting mechanisms.

When the first and second portions 72, 74 of the pallet 70 are arranged in the first position shown in FIG. 10, one or more feet 82 of the first portion may be adjacent one or more feet 84 of the second portion; one or more feet 82 of the second portion may be adjacent one or more feet 84 of the first portion; and one or more feet 86 of the first and second portions may be adjacent to each other. Significantly, this may create an arrangement of one or more pairs of adjacent feet 82, 84 and/or one or more pairs of adjacent feet 86 that may help strengthen and/or reinforce the pallet 88. For example, one or more pairs of adjacent feet may be disposed at least proximate one or more of the sides, one or more of corners and/or the central portions of the pallet 70, portions 72, 72 and/or decks 76 to help provide a pallet with generally uniform strength.

The first and second portions 72, 74 of the pallet 70 may include magnets and/or other structures configured to help secure the first and second portions in the first position shown in FIG. 10. For example, one or more metal members 96 may be connected to the feet 82, 84, 86, and one or more magnets 98 may be connected to the decks 76 of the portions 72, 74. Advantageously, the metal members 96 and the magnets 98 may be generally aligned when the portions 72, 74 are in the first position. This may advantageously help secure the portions 72, 74 in the first position.

In further detail, the feet 82, 84, 86 may have a body including a base connected and/or disposed proximate to the deck 76 and an end that extends away from the base and deck. The metal members 96 may disposed at least proximate the ends of the feet 82, 84, 86 and the magnets 98 may be disposed at least proximate the bases of the feet. For example, the metal members 96 may be connected to receiving portions 100 on the ends of the feet 82, 84, 86 and the magnets 98 may be connected to receiving portions 102 near the bases of the feet. Of course, the magnets 98 could be connected to the receiving portions 100 and the metal members 96 could be connected to the receiving portions 102, if desired. The receiving portions 100, 102 may be sized and configured to receive and/or retain at least a portion of the metal members 96 and the magnets 98.

As shown in FIG. 12, the metal members 96 and the magnets 98 may be connected to the receiving portions 100, 102 using adhesives 104, 106. For example, the first and second portions 72, 74 of the pallet 70 may be formed, for instance via a molding or other suitable manufacturing process, and then the metal members 96 and the magnets 98 may be connected to the receiving portions 100, 102 using adhesives 104, 106 and/or any other suitable means. It will be appreciated that pallet 70 does not require the receiving portions 100, 102 and that the metal members 96 and the magnets 98 may be connected to any other parts of the pallet 70.

The metal members 96 may include, for example, metal plates, beams, tubes and the like that may be constructed from steel and/or other suitable metals. If desired, the metal members 96 could be replaced by magnets or other structures to which the magnets 98 can be attracted.

As shown in FIG. 10, the receiving portions 100, 102 may include elongated recesses. The metal members 96 and/or the magnets 98 may also have elongated shapes that may correspond to the shape and/or size of the elongated recesses. It will be appreciated, however, that the recesses, metal members 96 and/or magnets 98 do not not require elongated shapes and may have other suitable shapes and/or sizes. It will be appreciated that the pallet 70 does not require any magnets or metal members depending, for example, upon the particular configuration of the pallet 70.

As noted above, to facilitate more efficient storage, the first and second portions 72, 74 of the pallet 70 may be arranged in a second position in which the portions face generally the same direction and/or nest together. If desired, three or more of the portions 72, 74 may face generally the same direction and/or nest together. This nested arrangement may significantly decrease the amount of storage spaced need to store and/or transport the portions 72, 74.

The first and second portions 72, 74 may include one or more engaging and/or interlocking features that may be used to help secure the portions in the nested second position. For example, the first portion 72 may include a foot that is sized and configured to engage and/or interlock with a foot of the second portion 74 when the first and second portions are in the second position. Similarly, the second portion 74 may include a foot that is sized and configured to engage and/or interlock with a foot of the first portion 72 when the first and second portions are in the second position.

In further detail, the feet 82, 84, 86 of the first and second portions 72, 74 may include hollow interiors, which may allow the feet to nest together in the more compact second position. For example, the first portion's feet 82, 84, 86 may be at least partially inserted into the hollow interiors of the second portion's feet 82, 84, 86, respectively, or the second portion's feet 82, 84, 86 of may be at least partially inserted into the hollow interiors of the first portion's feet 82, 84, 86, respectively. This may allow the feet 82, 84, 86 to engage and/or interlock with each other, which may advantageously help secure the first and second portions 72, 74 in the second position. The feet 82, 84, 86 may be further sized and configured to engage and/or interlock with each other using a snap, friction and/or interference fit when the first and second portions 72, 74 are in the second position.

Desirably, when the first and second portions 72, 74 are stacked in the nested, second position, the metal members 96 may be positioned to extend the lifespan of the portions 72, 74. For example, the metal members 96 may be constructed from steel and/or other relatively hard and durable metals and may be disposed on the ends of one or more of the feet 82, 84, 86. In particular, as shown above, the metal members 96 may be connected to the receiving portions 100. Desirably, if the metal members 96 are disposed on the ends of the feet 82, 84, 86, this may allow the metal members to contact and rest upon a support surface when the portions 72, 74 are stacked in the nested position. For instance, the metal members 96 of the portion 72, 74 at the bottom of the stack contact and rest upon the support surface. This may advantageously reduce wear and tear to whichever portion 72, 74 is at the bottom of the stack and thus significantly extend its lifespan. Where the portions 72, 74 are interchangeably nestable, this may help extend the lifespan of all of the portions.

In addition, when the first and second portions 72, 74 are stacked in the nested, second position, the magnets 98 may be positioned to extend their lifespans. For example, the magnets 98 may be disposed at least proximate the bases of the feet 82, 84, 86. In particular, as shown above, the magnets 98 may be connected to the receiving portions 102. Desirably, if the magnets 98 are disposed disposed at least proximate the bases of the feet 82, 84, 86, this may allow the magnets to be spaced apart from a support surface upon which the stacked, nested portions 72, 74 rest. In particular, the magnets 98 of the portion 72, 74 at the bottom of the stack may be spaced apart from the support surface. This may advantageously reduce wear and tear to the magnets 98 of whichever portion 72, 74 is at the bottom of the stack and thus significantly extend its magnets' lifespan. Where the portions 72, 74 are interchangeably nestable, this may help extend the lifespan of the magnets 98 of all of the portions. This may be particularly advantageous if the magnets 98 are constructed from softer materials that may be more susceptible to damage.

If desired, when the first and second portions 72, 74 of the pallet 70 are in the second position, the magnets 98 of the first and second portions may be disposed at least proximate to each other. Consequently, the positive and negative portions of the magnets 98 may be disposed towards each other to pull and/or keep themselves together. By pulling and/or keeping themselves together, the magnets 98 may help retain the first and second portions 72, 74 of the pallet 70 together.

Thus, as shown above, the magnets 98 may be configured to help secure the first and second portions 72, 74 of the pallet 70 in the first position shown in FIG. 11, the nested second position, or both, if desired. Moreover, as shown above, if the first and second portions 72, 74 are unintentionally dislodged from the first or second position, the magnets 98 may help pull the first and second portions from the dislodged position back to the first or second position.

If desired, the portions 12, 14, 72, 74 may be sized and configured to be independently used as pallets. For example, the feet 22, 24, 26, 82, 84, 86 of a portion 12, 14, 72, 74 may rest upon a support surface, such as the ground or a rack, to provide a platform upon which one or more items may be placed for storage and/or shipping. In some embodiments, the portion 12 and the portion 14 may be sized and configured to provide platforms at the same or at least substantially the same height above the support surface, for instance, where the portions have generally the same configuration of decks 16, feet 22, feet 24 and/or feet 26 or are at least substantially interchangeable Likewise, the portion 72 and the portion 74 may be sized and configured to provide platforms at the same or at least substantially the same height above the support surface, for instance, where the portions have generally the same configuration of decks 76, feet 82, feet 84 and/or feet 86 or are at least substantially interchangeable.

When the portions 12, 14, 72, 74 are independently used as pallets, the metal members and/or magnets may be positioned to extend the lifespan of the portions 12, 14, 72, 74 and magnets. In particular, when an individual portion 12, 14, 72, 74 rests upon the support surface, its metal members may contact and rest upon the support surface, which may advantageously prevent damage to the portion 12, 14, 72, 74 and thus substantially extend its lifespan. In addition, when the individual portion 12, 14, 72, 74 rests upon the support surface, the magnets may be spaced apart from the support surface. This may advantageously reduce wear and tear to the magnets 98 and thus substantially extend their lifespans.

The decks 16, 76 and the feet 22, 24, 26, 82, 84, 86 of a portion 12, 14, 72, 74 are preferably constructed from plastic, such as high-strength polymers or other plastics. Desirably, the plastic decks and feet may be strong and durable and may not splinter, like convention al wood pallets. Moreover, the plastic decks and feet may have any of a variety of different colors, if desired. It will be appreciated, however, that the decks and feet need not be constructed from plastic and may be constructed from wood, metal, and/or any other suitable material.

If desired, the deck and the feet of a portion 12, 14, 72, 74 may be integrally formed as part of a unitary, one-piece structure. For example, the deck 16 and the feet 22, 24, 26 may be constructed from plastic and may be integrally formed as part of a unitary, one-piece structure during a molding process, and the deck 76 and the feet 82, 84, 86 may be constructed from plastic and may be integrally formed as part of a unitary, one-piece structure during a molding process. In addition, other features may be integrally formed in the unitary, one-piece structure, such as the receiving portions 100, 102 and/or ribs. In particular, the decks 16, 76 of the portions 12, 14, 72, 74 may include a plurality of ribs, which may be integrally formed in the unitary, one-piece structure. For example, as shown in FIG. 10, the deck 76 may have a waffle-shaped configuration and the ribs may be arranged in a grid. Desirably, the ribs may be sized and configured to help strengthen and/or reinforce the pallets and may advantageously allow the pallets to weigh less.

The magnets 38, 40, 98 and/or metal members 96 may embedded into the unitary, one-piece structure during the molding process. For example, the unitary, one-piece structure may be formed using a mold into which the magnets 38, 40, 98 and metal members 96 and an amount of plastic may be placed as part of an insert-molding process, an over-molding process or the like. The unitary, one-piece structure may be constructed using an injection molding process, a blow-molding process, a compression-molding process, other molding processes and/or other suitable manufacturing processes.

The magnets 38, 40, 98, if desired, may be disposed inside holsters and/or insulators. Thus, the magnets 38, 40, 98, holsters and/or insulators may be molded and/or embedded into the plastic. The holsters and/or insulators may be constructed from ceramic and/or other suitable materials. Significantly, the holsters and/or insulators may help the magnets retain their magnetism when subjected to high temperatures in the molding and/or embedding processes. Thus, the holsters and/or insulators may help prevent the magnets from demagnetizing under such temperatures. It will be appreciated, however, that the holsters and/or insulators are not required and other methods may be used to help retain the magnets' magnetism and minimize the loss of the magnetism.

The magnets 38, 40, 98, metal members 96, holsters and/or insulators may include one or more anchors, such as, projections, extensions, dovetail-shaped structures, etc. The anchors may facilitate the connection and/or embedding of the magnets 38, 40, 98, metal members 96, holsters and/or insulators. For example, the anchors may extend away from a body of the magnets 38, 40, 98, metal members 96, holsters and/or insulators, which may allow the anchors to be surrounded and/or encapsulated within plastic (for instance during the molding process) or surrounded and/or encapsulated within an adhesive (such as, the adhesives 104, 106). Desirably, this may help better secure the magnets, metal members, holsters and/or insulators to the pallets 10, 70. It will be appreciated, however, that the magnets 38, 40, 98, metal members 96, holsters and/or insulators need not be embedded in the unitary, one-piece structure and may be connected to a deck 16, 76, the feet 22, 24, 26, 82, 84, 86 and/or the unitary, one-piece structure using one or more fasteners, adhesives, welds and/or any other suitable means. It will also be appreciated that the deck 16, 76, the feet 22, 24, 26, 82, 84, 86 and/or the portions 100, 102 need not be integrally formed as part of a unitary, one-piece structure and may comprise separately formed components that may be connected using any suitable means.

The decks 16, 76 and/or the portions 12, 14, 72, 74 may also include one or more metal reinforcing members, such as steel rods or tubes. The reinforcing members may be disposed inside the decks 16, 76 and/or the portions 12, 14, 72, 74, if desired. The reinforcing members may also be connected to the decks 16, 76 and/or the portions 12, 14, 72, 74, and the reinforcing members may be exposed. It will be appreciated, however, that the reinforcing members are not required.

If desired, a first portion 12, 72 and a second portion 14, 74 may be movably and/or pivotally connected by a hinge or the like to allow the portions to rotate between use and storage positions. When the pallet is in the use position, the first and second portions may face in generally opposite directions. When the pallet is in the collapsed position, the first and second portions may face the same direction and the portions of multiple pallets may be nested together. It will be appreciated, however, that a movable and/or pivotal connection is not required.

As discussed above, the portions 12, 14, 72, 74 may be arranged in a second, nested position that may be more compact than the first, use position to help facilitate more efficient storage at the destination location and more efficient shipping back to source locations for reuse.

In greater detail, the portions 12, 14, 72, 74 of pallets 10, 70 may be arranged in the first, use position at a source location. For example, at the source location, a user may manually move a first portion 12, 72 and a second portion 14, 74 to the first, use position to create a pallet 10, 70, such as a dual-deck pallet.

The magnets 38, 40, 98 and/or metal members 96 may advantageously help retain the first and second portions 12, 14, 72, 74 in the first position. In addition, one or more locking mechanisms may be used to help retain the first and second portions 12, 14, 72, 74 in the first position. For example, to help retain the first and second portions 12, 14, 72, 74 in the first position, the user may manually pivot and/or move one or more latches 62 from a disengaged or unlocked position to an engaged or locked position. As shown above, the latches 62 may be configured to automatically pivot and/or move from the disengaged or unlocked position to the engaged or locked position, for instance, when the first and second portions 12, 14, 72, 74 are moved to the first position.

After the portions 12, 14, 72, 74 of pallets 10, 70 are arranged in the first, use position at the source location, goods may be loaded onto and/or secured to the pallets. The pallets 10, 70 and the goods may then be shipped from the source location to a destination location.

At the destination location, the goods may be unloaded from the pallets 10, 70, and the portions 12, 14, 72, 74 of the pallets 10, 70 may be arranged in the second, nested position for storage. For example, at the source location, a user may manually arrange the portions 12, 14, 72, 74 in the second, nested position for storage. Where one or more latches 62 or other locking mechanisms were used to help retain the first and second portions 12, 14, 72, 74 in the first position, the user may manually pivot and/or move the latches 62 from the engaged or locked position to the disengaged or unlocked position and then may arrange the portions 12, 14, 72, 74 in the second, nested position.

When a sufficient number of the portions 12, 14, 72, 74 have been received at the destination, the portions 12, 14, 72, 74 may be shipped, while in the second position, back to a source location for reuse. After arriving back at the source location, the portions 12, 14, 72, 74 of the pallets 10, 70 may be stored in the second, nested position. When reuse of the portions 12, 14, 72, 74 is desired, the portions may be arranged in the first, use position and loaded with goods for shipping, as discussed above.

In one exemplary embodiment, 32 of the portions 12, 14, 72, 74 (which may be used to create 16 pallets) may be arranged in a six-foot high stack when arranged in the second, nested position, while only 13 conventional pallets can fit in a six-foot high stack. Also, in this exemplary embodiment, 1,920 of the portions 12, 14, 72, 74 (which may be used to create 960 pallets) may fit in a trailer when arranged in the second, nested position, while only 540 conventional pallets can fit in the trailer. Thus, at least about twenty-three to seventy-seven percent (23%-77%) more pallets may be stored and/or shipped using the portions 12, 14, 72, 74. Significantly, because more pallets 10, 70 may be stored at the destination and/or shipped in a trailer, the transportation and storage costs of reusing the pallets may be significantly less than the costs with conventional pallets. It will be appreciated that where hundreds, thousands and even hundreds of thousands of the pallets 10, 70 are stored and reused, this may result in substantial savings in transportation and storage costs.

Other suitable features for pallets are disclosed in U.S. provisional patent application Ser. No. 61/121,625, filed Dec. 11, 2008 and entitled PALLET, and U.S. provisional patent application Ser. No. 61/173,591, filed Apr. 28, 2009 and entitled PALLET, the disclosures of which are incorporated by reference herein in their entireties.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A pallet comprising:

a first portion including a base and an outwardly extending foot, the first portion comprising:

a first receiving portion disposed at least proximate a distal end of the foot; and a second receiving portion disposed at least proximate an intersection of the base and the foot, the first receiving portion, the second receiving portion and the first portion integrally formed as part of a unitary, one-piece construction;

a second portion including a base and an outwardly extending foot, the second portion comprising:

a first receiving portion disposed at least proximate a distal end of the foot; and a second receiving portion disposed at least proximate an intersection of the base and the foot, the first receiving portion, the second receiving portion and the second portion integrally formed as part of a unitary, one-piece construction; and a first magnet sized and configured to connect the first portion and the second portion, the first magnet at least partially disposed in one of said receiving portions of the first portion of the pallet.

2. The pallet as in claim 1, wherein the pallet is a dual-deck pallet and the first and second portions are sized and configured to be arranged in a first, use position in which the base of the first portion forms a first deck of the dual-deck pallet, the base of the second portion forms a second deck of the dual-deck pallet, the foot of the first portion extends towards the base of the second portion, and the foot of the second portion extends towards the base of the first portion.

3. The pallet as in claim 2, wherein the first and second portions are sized and configured to be arranged in a second, storage position in which the first portion is stacked upon the second portion and the foot of the first portion nests within a hollow interior of the foot of the second portion; and wherein the first and second portions are sized and configured to be arranged in a third, storage position in which the second portion is stacked upon the first portion and the foot of the second portion nests within a hollow interior of the foot of the first portion.

4. The pallet as in claim 2, wherein the foot of the first portion further comprises an opening in the distal end of the foot;

wherein, when the first and second portions are in the first use position, the foot of the second portion is inserted into and interlocks with the opening in the end of the foot of the first portion.

5. The pallet as in claim 2, wherein, when the first and second portions are arranged in the first use position, the foot of the first portion is positioned adjacent the foot of the second portion.

6. The pallet as in claim 2, further comprising a second magnet at least partially disposed in one of said receiving portions of the second portion of the pallet;

wherein, when the first and second portions are arranged in the first use position, the first and second magnets are generally aligned to secure the first and second portions in the first position.

7. The pallet as in claim 6, wherein the first magnet is disposed in the second receiving portion of the first portion of the pallet; and wherein the second magnet is disposed in the second receiving portion of the second portion of the pallet.

8. The pallet as in claim 6, wherein the first magnet is disposed in the first receiving portion of the first portion of the pallet; and wherein the second magnet is disposed in the first receiving portion of the second portion of the pallet.

9. The pallet as in claim 1, further comprising a first metal member disposed in the first receiving portion of the second portion of the pallet;

wherein the first magnet is disposed in the second receiving portion of the first portion of the pallet; and wherein, when the first and second portions are arranged in the first use position, the first magnet and the first metal member are generally aligned to secure the first and second portions in the first position.

10. The pallet as in claim 1, further comprising a first metal member disposed in the second receiving portion of the second portion of the pallet;

wherein the first magnet is disposed in the first receiving portion of the first portion of the pallet; and wherein, when the first and second portions are arranged in the first use position, the first magnet and the first metal member are generally aligned to secure the first and second portions in the first position.

11. The pallet as in claim 1, further comprising a first insulator disposed in one of said receiving portions of the first portion of the pallet, the first magnet disposed in the first insulator; and further comprising a second insulator disposed in one of said receiving portions of the second portion of the pallet, a second magnet disposed in the second insulator.

12. A pallet comprising:

a plastic base including a plurality of outwardly extending feet, the base and the feet integrally formed as part of a unitary, one-piece construction;

a first receiving portion disposed at least proximate a distal end of each of the feet;

a second receiving portion disposed at least proximate an intersection of each of the feet and the base, the first receiving portion and the second receiving portion integrally formed with the base and the feet as part of the unitary, one-piece construction;

a first magnetic element at least partially disposed in the first receiving portion; and a second magnetic element at least partially disposed in the second receiving portion, the first magnetic element and the second magnetic element being spaced apart by a distance, the first magnetic element and the second magnetic element being disposed in separate planes, wherein the first magnetic element is sized and configured to be magnetically coupled to a second magnetic element of a base of an adjacent inverted pallet.

13. The pallet as in claim 12, further comprising an insulator disposed in the second receiving portion, the second magnetic disposed within the insulator.

14. The pallet as in claim 12, wherein the first receiving portion is disposed at the distal end of the feet and the first magnetic element comprises a metal member; and wherein the second receiving portion is spaced apart from an adjacent foot by a distance and the second magnetic member comprises a magnet.

15. The pallet as in claim 12, wherein the plurality of feet includes at least two generally aligned feet in a first direction and at least two generally aligned feet in a second direction;

wherein a first plurality of strengthening members are disposed between the feet in the first direction; and wherein a second plurality of strengthening members are disposed between the feet in the second direction.

16. The pallet as in claim 12, wherein the plurality of feet includes at least two generally aligned feet; and wherein a plurality of reinforcing members are at least partially disposed between the generally aligned feet.

17. The pallet as in claim 12, wherein the first magnetic element forms a lower portion of the foot.

18. The pallet as in claim 12, wherein one or more feet of the plurality of feet include the second receiving portion on a first side of the feet and wherein one or more feet of the plurality of feet include the second receiving portion on an opposing second side of the feet.

19. The pallet as in claim 12, further comprising an opening disposed at the distal end of the feet, the first receiving portions being disposed about the opening.

* * * * *

UNITED STATES PATENT AND TRADEMARK OFFICE

CERTIFICATE OF CORRECTION

PATENT NO. : 8,356,562 B2
APPLICATION NO. : 12/635648
DATED : January 22, 2013
INVENTOR(S) : Palmer It is certified that error appears in the above-identified patent and that said Letters Patent is hereby corrected as shown below:

In the Specifications:

In Column 1, Line 44, delete "form" and insert -- from --, therefor.

In Column 2, Line 10, delete "resist to" and insert -- resistant to --, therefor.

In Column 2, Line 12, delete "weight" and insert -- weigh --, therefor.

In Column 2, Line 20, delete "resist to" and insert -- resistant to --, therefor.

In Column 2, Line 25, delete "disadvantageous" and insert -- disadvantages --, therefor.

In Column 4, Lines 62-63, delete "may a latch" and insert -- may include a latch --, therefor.

In Column 5, Line 32, delete "if desired" and insert -- If desired --, therefor.

In Column 5, Line 57, delete "FIG. 4 is side view" and insert -- FIG. 4 is a side view --, therefor.

In Column 6, Line 66, delete "second ends of the deck" and insert -- second ends 18, 20 of the deck --, therefor.

In Column 7, Line 67, delete "of the pallet" and insert -- of the pallet 10 --, therefor.

In Column 9, Line 41, delete "space need" and insert -- space needed --, therefor.

In Column 10, Line 21, delete "one portion are within" and insert -- one portion within --, therefor.

In Column 10, Line 37, delete "be replaced other" and insert -- be replaced by other --, therefor.

Signed and Sealed this
Third Day of September, 2013

Teresa Stanek Rea
*Acting Director of the United States Patent and Trademark Office*

In Column 12, Line 3, delete “that may automatically” and insert -- may automatically --, therefor.

In Column 13, Line 20, delete “portions 72, 72” and insert -- portions 72, 74 --, therefor.

In Column 14, Line 11, delete “space need” and insert -- space needed --, therefor.

In Column 14, Line 50, delete “the stack contact and rest” and insert -- the stack may contact and rest --, therefor.

In Column 14, Line 62, delete “are disposed disposed at least” and insert -- are disposed at least --, therefor.

In Column 15, Line 35, delete “interchangeable Likewise,” and insert -- interchangeable. Likewise, --, therefor.

In Column 15, Line 57, delete “like convention al wood” and insert -- like conventional wood --, therefor.